US005465639A

United States Patent [19]

Senbokuya

[11] Patent Number: 5,465,639

[45] Date of Patent: Nov. 14, 1995

[54] METHOD AND APPARATUS FOR CUTTING A BELT-SHAPED MEMBER

[75] Inventor: Takashi Senbokuya, Tokyo, Japan

[73] Assignee: Bridgestone Corporation, Tokyo, Japan

[21] Appl. No.: 87,000

[22] Filed: Jul. 7, 1993

[30] Foreign Application Priority Data

Jul. 7, 1992 [JP] Japan ..... 4-203156
Jul. 21, 1992 [JP] Japan ..... 4-215548

[51] Int. Cl.[6] ..... B26D 1/18; B26D 1/20

[52] U.S. Cl. ..... 83/34; 83/42; 83/56; 83/487; 83/508; 83/578; 83/582; 83/614

[58] Field of Search ..... 83/34, 42, 56, 83/485, 486, 486.1, 487, 508, 578, 488, 496, 497, 508.2, 582, 614, 556

[56] References Cited

U.S. PATENT DOCUMENTS

| | | | |
|---|---|---|---|
| 2,631,669 | 3/1953 | Baker | 83/485 X |
| 3,143,023 | 8/1964 | Addin | 83/485 X |
| 3,274,877 | 9/1966 | Seyler | 83/486 X |
| 3,319,500 | 5/1967 | Wild et al. | 83/487 X |
| 4,003,281 | 1/1977 | Kumpf et al. | 83/487 X |
| 4,046,044 | 9/1977 | Paterson et al. | 83/508 X |
| 4,665,787 | 5/1987 | Arnold et al. | 83/485 |
| 5,168,786 | 12/1992 | Huggins et al. | 83/508 X |
| 5,303,626 | 4/1994 | Uehara et al. | 83/485 |
| 5,307,716 | 5/1994 | Onishi et al. | 83/508 X |
| 5,373,766 | 12/1994 | Ranly et al. | 83/497 X |

FOREIGN PATENT DOCUMENTS

| | | | |
|---|---|---|---|
| 0172319 | 2/1986 | European Pat. Off. . | |
| 1428170 | 1/1966 | France | 83/485 |
| 2292559 | 6/1976 | France . | |
| 1248455 | 8/1963 | Germany . | |
| 2007689 | 9/1970 | Germany | 83/487 |
| 1729653 | 7/1971 | Germany | 83/486.1 |
| 2121171 | 11/1971 | Germany | 83/485 |
| 3900414 | 1/1989 | Germany . | |
| 50-24466 | 8/1975 | Japan . | |
| 50793 | 8/1941 | Netherlands | 83/485 |
| 899348 | 6/1962 | United Kingdom | 83/485 |

*Primary Examiner*—Rinaldi I. Rada
*Assistant Examiner*—Clark F. Dexter
*Attorney, Agent, or Firm*—Sughrue, Mion, Zinn, Macpeak & Seas

[57] ABSTRACT

An apparatus for cutting a belt-shaped member includes: a lower blade; a cutter; a holder for supporting the cutter; a carriage for revolving the holder about an axis of revolution intersecting an axis of rotation of the cutter by maintaining a very small angle to the axis of rotation of the cutter; a revolving mechanism for revolving the holder about the axis of revolution to cause the cutter to undergo precession about the axis of revolution, a direction of inclination of the cutter being set such that, when the belt-shaped member is cut from one side toward other side of the lower blade, a side of the cutter on the other side of the lower blade is located closer to the lower blade, while when the belt-shaped member is cut from the other side toward the one side of the lower blade, a side of the cutter on the one side of the lower blade is located closer to the lower blade; and a moving mechanism for moving the cutter and the holder along the lower blade.

14 Claims, 7 Drawing Sheets

METHOD AND APPARATUS FOR CUTTING A BELT-SHAPED MEMBER

BACKGROUND OF THE INVENTION

1. Field of the Invention

The present invention relates to a method and apparatus for cutting a belt-shaped member substantially transversely by using a rectilinear lower blade and a disk-shaped cutter.

2. Description of the Related Art

As a conventional method and apparatus for cutting a belt-shaped member, those which are disclosed in, for instance, Japanese Patent Application Laid-Open No. 135108/1985 are known. The apparatus disclosed therein includes a rectilinear lower blade disposed immediately below a belt-shaped member and extending in the transverse direction of the belt-shaped member; a freely rotatable disk-shaped upper blade, or cutter, which is inclined at a very small angle with respect to the lower blade in such a manner that the side of the upper blade on the other side of the lower blade is located closer to the lower blade, a portion of the upper blade being adapted to come into contact with the lower blade; a moving mechanism for cutting the belt-shaped member by means of the lower blade and the upper blade as the upper blade is moved along the lower blade from one end to the other end of the lower blade; a first cylinder for raising the upper blade after completion of cutting; a holding pawl disposed immediately above the belt-shaped member and extending along the lower blade; a holding mechanism for restricting the movement of the belt-shaped member during cutting by moving the holding pawl to press the belt-shaped member against the lower blade; a comb-shaped releasing pawl which is disposed immediately below the belt-shaped member in the vicinity of a cutting position, extends in parallel with the lower blade, and is capable of swinging vertically about a swinging shaft parallel with the lower blade; and a second cylinder for releasing the belt-shaped member adhering to the lower blade from the lower blade by upwardly pushing the belt-shaped member in the vicinity of the cutting position by upwardly swinging the releasing pawl about the swinging shaft when the holding pawl is disengaged from the belt-shaped member immediately after cutting. Accordingly, when the cutting of the belt-shaped member is completed, the releasing pawl is swung to release the belt-shaped member in the vicinity of the cutting position from the lower blade, and the upper blade is raised. Then, the belt-shaped member is fed by a predetermined length, and during this feeding, after the upper blade is moved by the moving mechanism from the other side to one side, the upper blade is lowered by the first cylinder so as to return the upper blade to its initial position.

However, with such a conventional method and apparatus for cutting a belt-shaped member, since the direction in which the upper blade is inclined with respect to the lower blade is unchangeable, the belt-shaped member can be cut only during the advancing movement (movement from one side to the other side) of the upper blade. As a result, after the cutting of the belt-shaped member, the operations of raising the upper blade and returning the upper blade from the other side to one side are required, so that there has been a drawback in that the operational efficiency is low.

In addition, with the conventional apparatus for cutting a belt-shaped member, since the belt-shaped member in the vicinity of the cutting position is pushed upward by upwardly swinging the releasing pawl so as to release the belt-shaped member adhering to the lower blade from the lower blade, the portion of the belt-shaped member located in the vicinity of the cutting position is deformed in a convex shape and is elongated during releasing. Consequently, there has been a drawback in that the quality of the cut belt-shaped member declines.

SUMMARY OF THE INVENTION

Accordingly, it is an object of the present invention to provide a method and apparatus for cutting a belt-shaped member which are capable of cutting the belt-shaped member with high efficiency.

Another object of the present invention is to provide an apparatus for cutting a belt-shaped member which, after cutting, is capable of releasing the belt-shaped member adhering to the lower blade from the lower blade with substantially no deformation of the belt-shaped member.

To these ends, in accordance with one aspect of the present invention, there is provided a method for cutting a belt-shaped member, comprising the steps of: cutting the belt-shaped member substantially transversely by moving the cutter along the lower blade from one side to the other side of the lower blade while the cutter is being held in contact with the lower blade in a state in which the cutter is inclined at a very small angle with respect to the lower blade such that a side of the cutter on the other side of the lower blade is located closer to the lower blade, so as to effect an advance cutting step; causing the cutter to undergo precession about an axis of revolution which intersects an axis of rotation of the cutter by maintaining a very small angle to the axis of rotation of the cutter so as to be inclined at the very small angle with respect to the lower blade such that a side of the cutter on the one side of the lower blade is located closer to the lower blade, and feeding the belt-shaped member by a predetermined length, so as to effect an inverting step; cutting the belt-shaped member substantially transversely by moving the cutter along the lower blade from the other side to the one side of the lower blade while the cutter is being held in contact with the lower blade, so as to effect a return cutting step; and causing the cutter to undergo precession about the axis of revolution to reset a direction and an angle of inclination of the cutter with respect to the lower blade to those persisting in the advance cutting step, and feeding the belt-shaped member by the predetermined length, so as to effect a resetting step.

In accordance with another aspect of the present invention, there is provided an apparatus for cutting a belt-shaped member, comprising: a lower blade disposed immediately below the belt-shaped member and extending perpendicular to a longitudinal direction of the belt-shaped member; a disk-shaped cutter for cutting the belt-shaped member in cooperation with the lower blade as a portion of the cutter is brought into contact with the lower blade by being inclined while maintaining a very small angle with respect to the lower blade; a holder for supporting the cutter; a carriage for supporting the holder and capable of revolving the holder about an axis of revolution intersecting an axis of rotation of the cutter by maintaining a very small angle to the axis of rotation of the cutter; a revolving mechanism for revolving the holder about the axis of revolution with respect to the carriage to cause the cutter to undergo precession about the axis of revolution, a direction of inclination of the cutter being set such that, when the belt-shaped member is cut from one side toward the other side of the lower blade, a side of the cutter on the other side of the lower blade is located closer to the lower blade, while when the belt-shaped member is cut from the other side toward the one side of the lower blade, a side of the cutter on the one side of the lower blade is located closer to the lower blade; and a moving mechanism for moving the carriage to move the cutter and the holder along the lower blade so as to cut the belt-shaped member by means of the lower blade and the cutter.

In a specific example of the present invention, it is preferred that the holder be formed in a hollow cylindrical shape whose inner peripheral surface is inclined at a very small angle with respect to an outer peripheral surface thereof, and that the holder revolve about the axis of revolution intersecting the axis of rotation of the cutter by maintaining the very small angle to the axis of rotation of the cutter. Preferably, the carriage has a spring for imparting an urging force to the cutter, and the cutter is pressed against the lower blade by the urging force of the spring to allow the portion of the cutter to be brought into contact with the lower blade. By virtue of such an apparatus in accordance with the present invention, the operation for vertically moving the cutter and the process for returning the cutter become unnecessary.

In accordance with still another aspect of the present invention, there is provided an apparatus for cutting a belt-shaped member, comprising: a lower blade disposed immediately below the belt-shaped member and extending perpendicular to a longitudinal direction of the belt-shaped member; a cutter for cutting the belt-shaped member substantially transversely in cooperation with the lower blade by moving along the lower blade; a pressing plate disposed immediately above the belt-shaped member and extending along the lower blade; a pressing mechanism for reciprocatably supporting the pressing plate and moving the pressing plate to press the belt-shaped member against the lower blade so as to restrict the movement of the belt-shaped member during cutting; a thin plate-shaped releasing member disposed immediately below the belt-shaped member in a vicinity of a cutting position and extending in parallel with the lower blade; and a pushing mechanism for supporting the releasing member and pushing the releasing member between the belt-shaped member and the lower blade by moving the releasing member along an upper surface of the lower blade in a direction substantially perpendicular to a longitudinal direction of the lower blade in a state in which the pressing plate after the cutting of the belt-shaped member is separated from the belt-shaped member, so as to release the belt-shaped member adhering to the lower blade from the lower blade.

In a specific example of the present invention, the pressing mechanism or a pushing mechanism preferably has a driving mechanism for imparting a driving force to both of the pressing mechanism and the pushing mechanism. Preferably, the pushing mechanism has a link for converting a driving force from the driving mechanism into a vertical displacement and an L-shaped link connected to the link and adapted to convert the driving force into a displacement in a direction substantially perpendicular to the longitudinal direction of the lower blade, and the releasing member is pushed in between the belt-shaped member and the lower blade by the link and the L-shaped link when the driving force is imparted from the driving mechanism to the releasing member. By virtue of such an apparatus of the present invention, it is possible to release from the lower blade the belt-shaped member adhering to the lower blade after cutting with practically no deformation of the belt-shaped member.

It is now assumed that the position for cutting the belt-shaped member is located immediately above the lower blade. At this time, a portion of the cutter is brought into contact with the lower blade and is inclined at a very small angle with respect to the lower blade. The direction of its inclination is such that the side of the cutter on the other side of the lower blade is located closer to the lower blade. Then, the moving mechanism is operated to move the holder along the lower blade from one side to the other side. At this time, since the cutter rotates freely, the belt-shaped member is cut substantially transversely at the cutting position by means of the cutter and the lower blade. Subsequently, the revolving mechanism is operated to revolve the holder 180° about the axis of revolution. Since this axis of revolution intersects the axis of rotation of the cutter by maintaining a very small angle to that axis of rotation, the cutter undergoes precession about the axis of revolution owing to the revolution of the holder, with the result that the direction of inclination with respect to the lower blade is inverted, i.e., the cutter is inclined such that the side of the cutter on one side of the lower blade is located closer to the lower blade. This precession stops when the angle of inclination of the cutter with respect to the lower blade becomes a predetermined very small angle. At the same time, the belt-shaped member is fed by a predetermined length to allow the cutting position for the belt-shaped member to be located above the lower blade. Next, the moving mechanism is operated to move the cutter along the lower blade from the other side toward one side while the cutter is held in contact with the lower blade, so as to cut the belt-shaped member substantially transversely at the cutting position. Subsequently, the revolving mechanism is operated to revolve the holder 180° about the axis of revolution so as to reset the direction and angle of inclination of the cutter with respect to the lower blade to those persisting during initial cutting. At the same time, the belt-shaped member is fed by a predetermined length. Then, as the above-described operation is repeated, the belt-shaped member is consecutively cut to predetermined lengths. Here, since the direction of inclination of the cutter with respect to the lower blade is inverted each time the cutting of the belt-shaped member is completed, it is possible to cut the belt-shaped member not only during the movement of the cutter from one side toward the other but also during the movement of the cutter from the other side toward one side. As a result, the operations of returning the cutter from the other side to one side and lifting the cutter become unnecessary, so that the efficiency of the cutting operation improves. Furthermore, since the inversion of the direction of inclination of the cutter with respect to the lower blade is effected by revolving the holder about the axis of revolution, the accuracy of inclination with respect to the lower blade after inversion becomes high as compared with a case where the cutter is directly made to undergo precession about the axis of rotation by means of a cylinder, a cam, or the like. Consequently, the cutting of the belt-shaped member can be effected accurately and reliably.

When the belt-shaped member is cut in the above-described manner, the pressing plate is moved toward the lower blade by the pressing mechanism, and the belt-shaped member in the vicinity of the cutting position is pressed against the lower blade by the pressing plate. Next, as the cutter is moved along the lower blade, the belt-shaped member is cut substantially transversely at the cutting position. At this time, since the pressing plate presses the belt-shaped member against the lower blade, the movement of the belt-shaped member is restricted. Here, since the belt-shaped member is firmly pressed against the lower blade by the cutter and the pressing plate, the belt-shaped member adheres to the lower blade during cutting. For this reason, the pushing mechanism is operated to push the releasing member between the belt-shaped member and the lower blade, thereby releasing the belt-shaped member adhering to the lower blade from the lower blade. At this time, since the releasing member has the configuration of a thin plate, and is moved along the upper surface of the lower blade in a direction substantially perpendicular to the longitudinal direction of the lower blade, the deformation of the belt-shaped member during releasing is practically nil. Thus, the quality of the cut belt-shaped member improves.

Furthermore, if a driving force from a driving mechanism is imparted to both of the pressing mechanism and the pushing mechanism, the driving mechanism can be made compact and produced at low cost. In addition, there is no lag in the timing of the pressing mechanism and the pushing mechanism, so that the efficiency of cutting operations improves.

The above and other objects, features and advantages of the present invention will become more apparent from the following detailed description of the invention when read in conjunction with the accompanying drawings.

DESCRIPTION OF THE PREFERRED EMBODIMENTS

Figure 1:
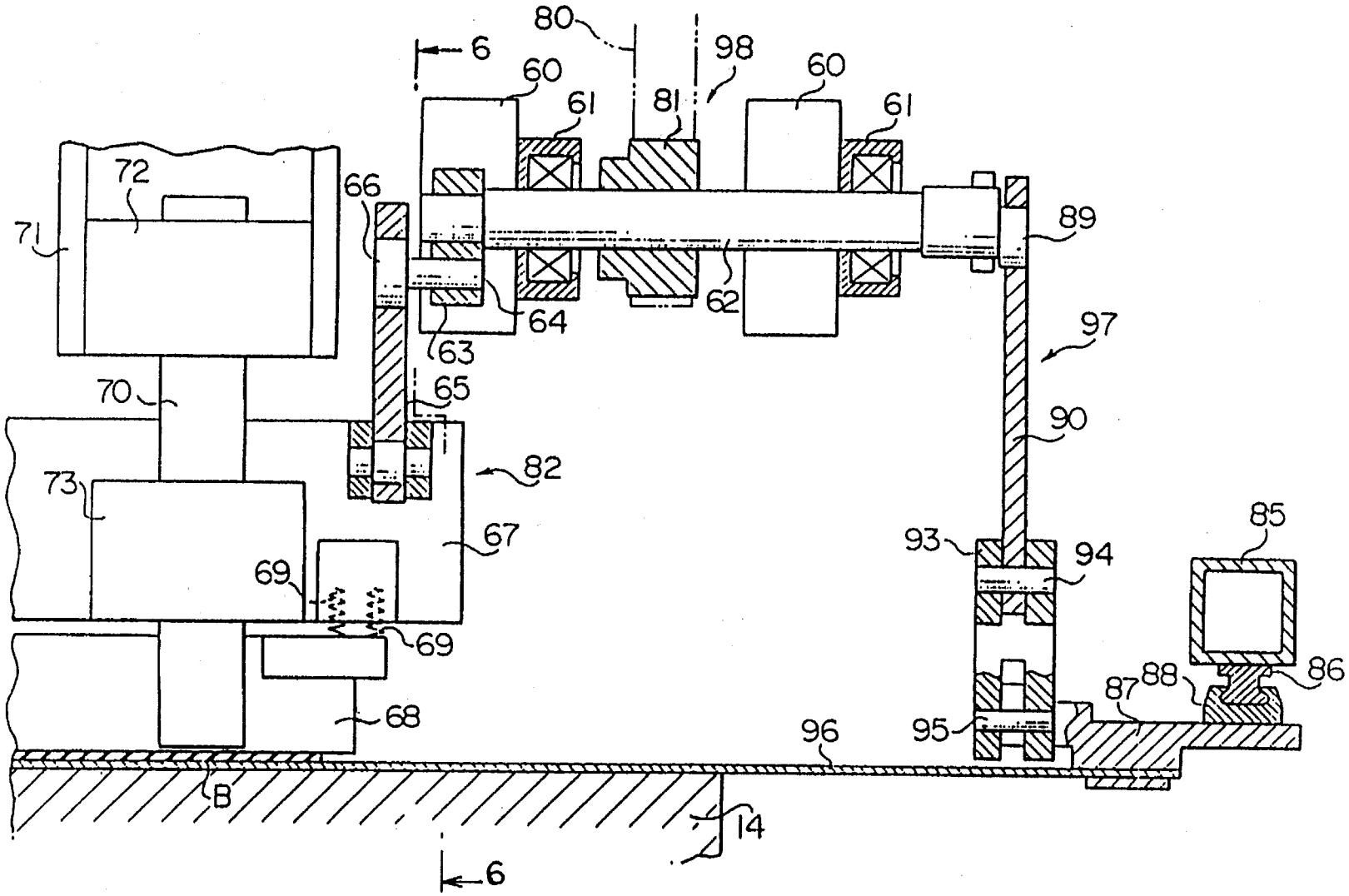
FIG. 1 is a front cross-sectional view, corresponding to the right side of the apparatus as shown in FIG. 2, of a holding mechanism and a pushing mechanism of a cutting apparatus and their vicinities in accordance with one embodiment of the present invention.
Figure 2:
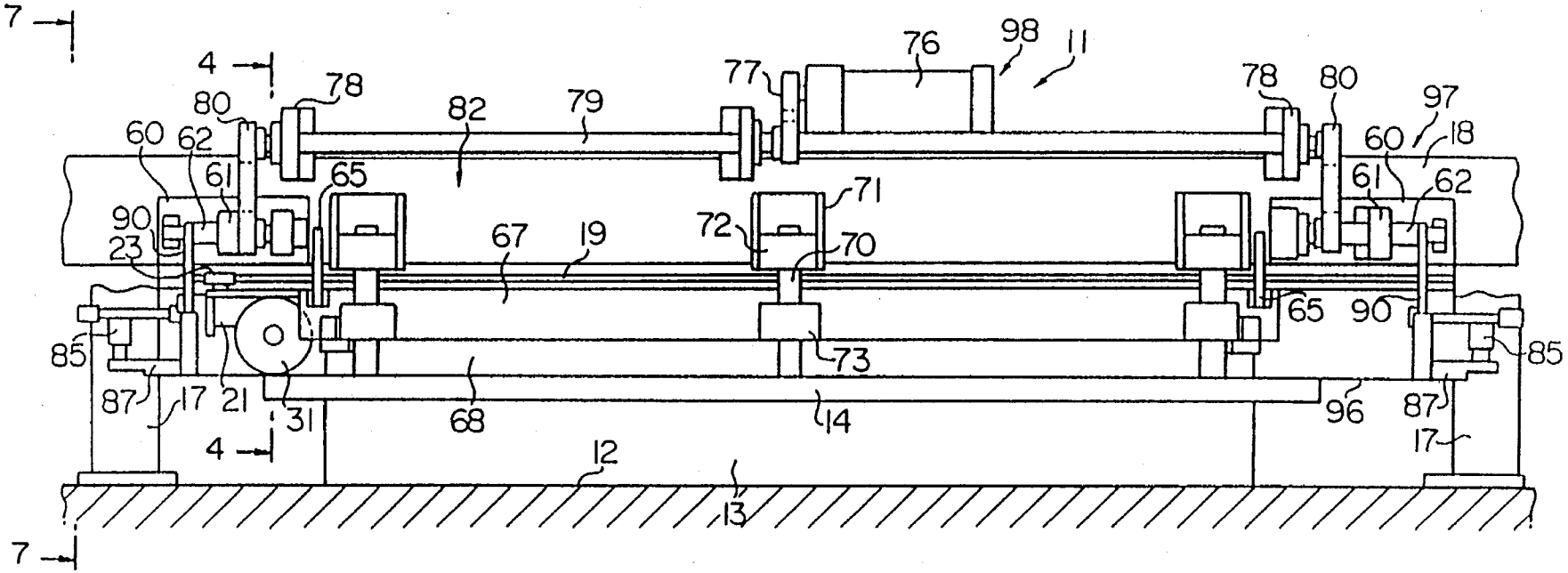
FIG. 2 is an overall front elevational view of the cutting apparatus in accordance with the embodiment of the present invention.

FIGS. 1 and 2 show a cutting apparatus 11 for substantially transversely cutting a belt-shaped member B, i.e., a belt-shaped rubber member in which cords formed of material such as polyester or nylon are embedded. This cutting apparatus 11 has a base 13 installed on a floor surface 12. Mounted on this base 13 is a horizontal rectilinear lower blade 14 located immediately below the belt-shaped member B and extending in the transverse direction of the belt-shaped member B.

Figure 3:
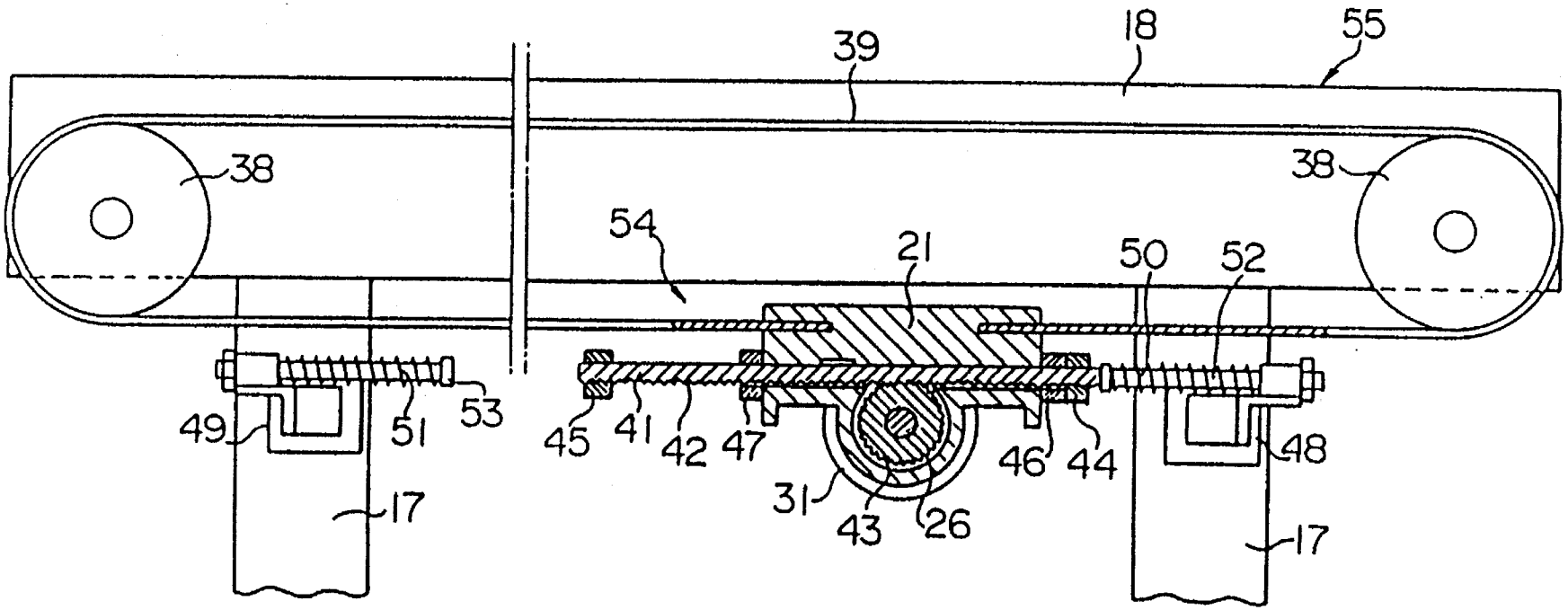
FIG. 3 is a partially cut-away rear view of a carriage and its vicinity.
Figure 4:
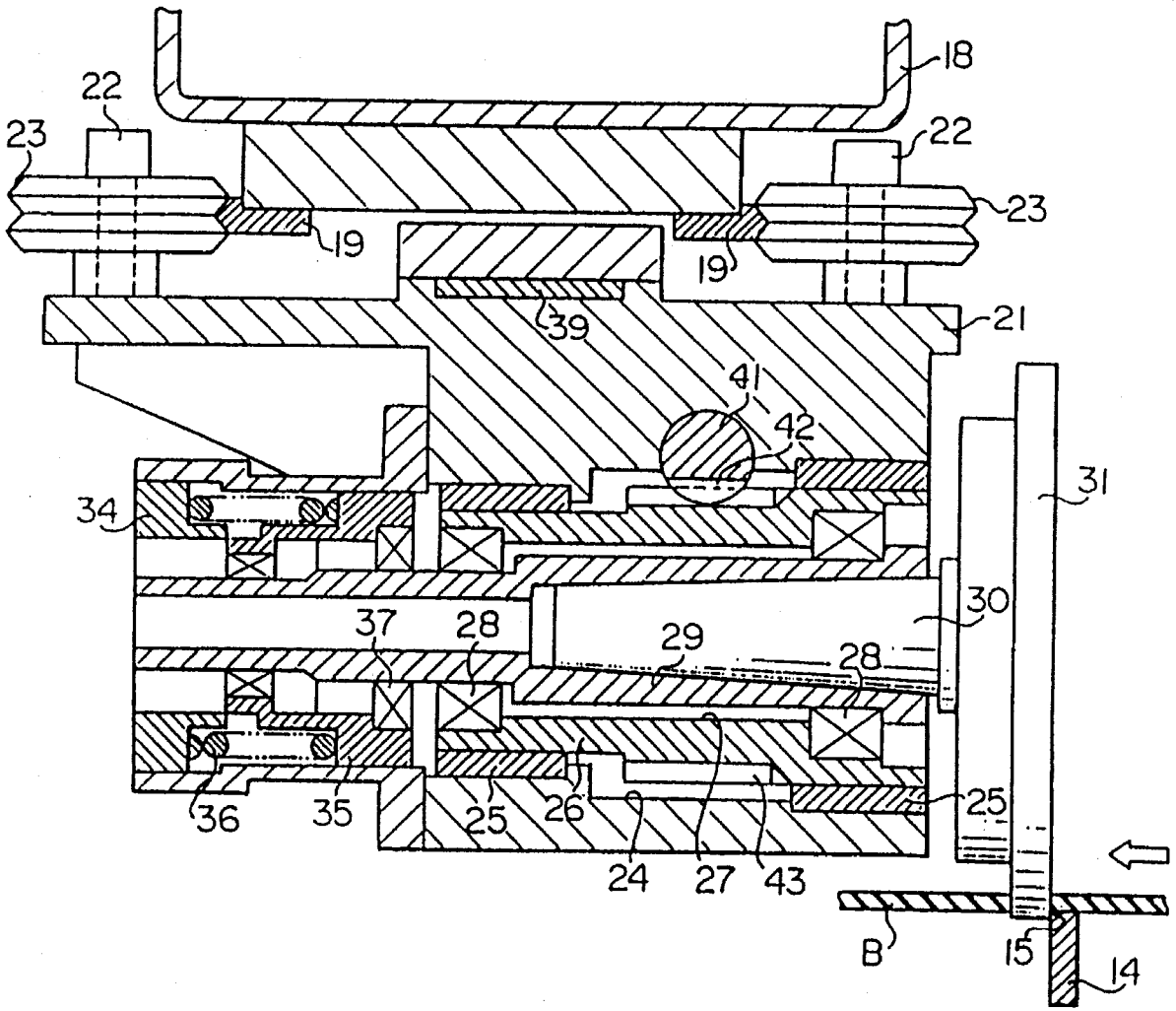
FIG. 4 is a cross-sectional view taken along line 4—4 in FIG. 2.
Figure 5:
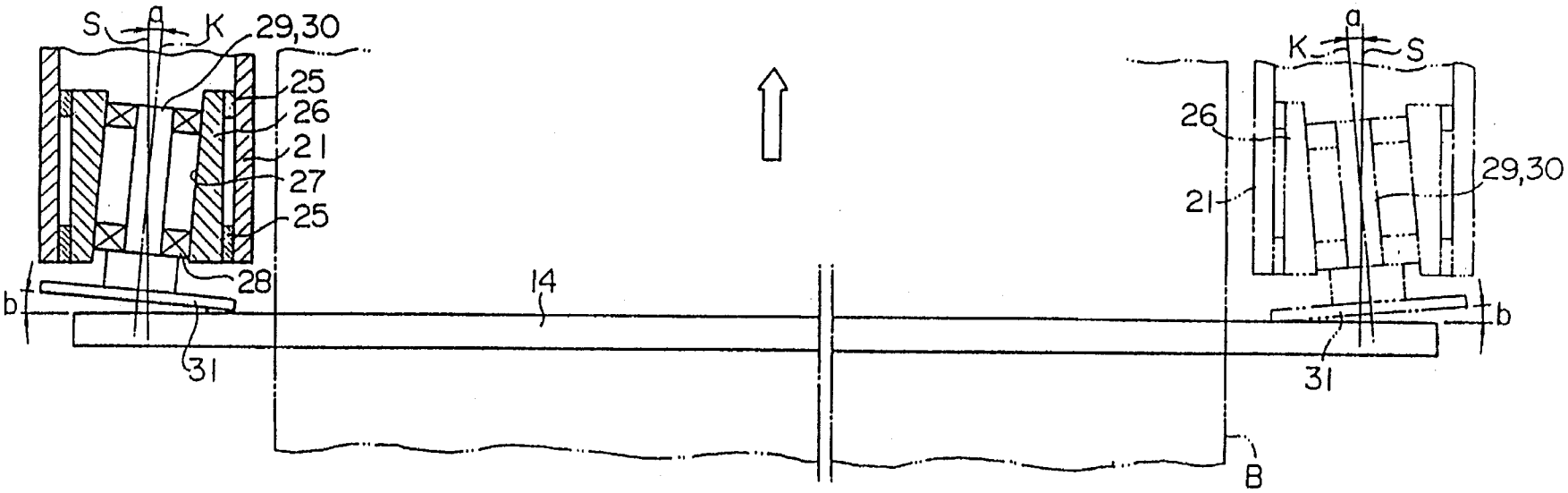
FIG. 5 is a schematic horizontal cross-sectional view of a cutter and a lower blade.

As shown in FIGS. 2, 3, 4, and 5, a pair of legs 17 are respectively disposed uprightly on the floor surface 12 at opposite sides of the base 13, and a fixed beam 18, which is parallel with the lower blade 14 and located immediately above the lower blade 14, is fixed on upper ends of these legs 17. As shown in FIG. 4, a pair of guide rails 19 extending in parallel with the lower blade 14 are attached to a lower portion of this fixed beam 18. A carriage 21 is located below the guide rails 19, and a plurality of guide rollers 23 are rotatably supported above an upper portion of the carriage 21 via vertical mounting shafts 22, respectively. These guide rollers 23 hold the guide rails 19 from the front and rear sides in a sandwiching manner. As a result, the carriage 21 is movably supported by the fixed beam 18. A horizontal support hole 24 is formed in this carriage 21 in such a manner as to extend in the transverse direction (in the left-and-right direction in FIG. 4), i.e., in the longitudinal direction of the belt-shaped member B. A holder 26 is supported in the support hole 24 via a pair of bearing rings 25 in such a manner as to be capable of revolving about an axis of revolution, S (see FIG. 5). An insertion hole 27, which is inclined with respect to the axis of revolution, S, at a very small angle a (see FIG. 5) in the horizontal plane, is formed in this holder 26. A hollow cylindrical shaft 29 is rotatably supported in this insertion hole 27 via a pair of bearings 28. Here, since the hollow shaft 29 is located coaxially with the insertion hole 27, so that its axis of rotation, K, intersects the axis of rotation, S, by maintaining the very small angle a in the horizontal plane. A fitting shaft 30 (see FIG. 4) is fitted in a forward end of the hollow shaft 29, and a disk-shaped cutter 31 coaxial with the hollow shaft 29 is formed integrally with a forward end of this fitting shaft 30. As a result, when the holder 26 revolves about the axis of revolution, S, the cutter 31 is capable of undergoing precession about the axis of revolution, S. Here, since the cutter 31 is supported by the holder 26 via the bearings 28, the fitting shaft 30 and the hollow shaft 29 are capable of rotating freely as a unit, and are inclined with respect to the lower blade 14 by maintaining a very small angle b in the horizontal plane (i.e., in a plane parallel with the plane of the drawing in FIG. 5). Here, when the belt-shaped member B is cut by means of the cutter 31 and the lower blade 14 from one side toward the other side of the lower blade 14, the direction in which the cutter 31 is inclined with respect to the lower blade 14 is such that the side of the cutter 31 on the other side of the lower blade 14 is located closer to the lower blade 14. 0n the other hand, when the belt-shaped member B is cut from the other side toward one side, the direction of inclination of the cutter 31 is such that the side of the cutter 31 on one side of the lower blade 14 is located closer to the lower blade 14. It should be noted that, in this embodiment, the aforementioned very small angles a and b are set to be identical at 0.5–0.08 degree or thereabouts.

As shown in FIG. 4, a spring seat 34 is fixed in a rear portion (a left-hand portion in FIG. 4) of the carriage 21, while a spring seat 35 is accommodated forwardly of the spring seat 34 in the carriage 21. A spring 36 is fitted between the spring seat 34 and the spring seat 35. The urging force of this spring 36 is transmitted to the hollow shaft 29 and the cutter 31 via the spring seat 35 and a bearing 37 connecting the spring seat 35 and the hollow shaft 29, thereby pressing a portion of the outer edge of the cutter 31 against a cutting edge 15 of the lower blade 14 with a fixed force. As shown in FIG. 3, a pair of pulleys 38 for rotating about their respective horizontal axes are supported on a rear surface of the fixed beam 18 at opposite ends of the fixed beam 18, respectively. A driving force from an unillustrated AC servo motor is transmitted to either of the pulleys 38. A belt 39 is trained between these pulleys 38, and opposite ends of this belt 39 are connected to the carriage 21. As a result, when the pulleys 38 rotate and the belt 39 travels, the carriage 21 travels along the lower blade 14 while being guided by the guide rails 19.

A rack shaft 41 whose axial direction is parallel with the longitudinal direction of the lower blade 14 is slidably inserted in the carriage 21. A rack 42 formed on this rack shaft 41 meshes with pinion teeth 43 formed on an outer periphery of the holder 26. Permanent magnets 44 and 45 are respectively secured to one end and the other end of the rack shaft 41, while iron pieces 46 and 47 capable of abutting against the permanent magnets 44 and 45 are respectively secured on one end face and the other end face of the carriage 21. This rack shaft 41 is capable of moving in the carriage 21 along the lower blade 14 between the position where the permanent magnet 44 and the iron piece 46 abut against each other and the position where the permanent magnet 45 and the iron piece 47 abut against each other. As the rack shaft 41 moves between these two positions, the holder 26 revolves 180 degrees, with the result that the direction of inclination of the cutter 31 with respect to the lower blade 14 is inverted. As shown in FIG. 3, brackets 48 and 49 are respectively secured to the legs 17, and stoppers 52 and 53 which are provided with a damping function by springs 50 and 51 are supported by these brackets 48 and 49. Then, when the carriage 21 moves to one side by the travelling of the belt 39 and the rack shaft 41 abuts against the stopper 52, the rack shaft 41 is pushed through the carriage 21 toward the other side until the permanent magnet 44 and the iron piece 46 abut against each other. Meanwhile, when the carriage moves to the other side and the rack shaft 41 abuts against the stopper 53, the rack 41 is pushed through the carriage 21 toward one side until the permanent magnet 45 and the iron piece 47 abut against each other. The aforementioned rack shaft 41, permanent magnets 44, 45, iron pieces 46, 47, and stoppers 52, 53 as a whole constitute a revolving mechanism 54. As the revolving mechanism 54 causes the holder 26 to revolve 180 degrees about the axis of revolution, S, the cutter 31 undergoes precession about the axis of revolution, S. Thus, when the belt-shaped member B is cut by means of the lower blade 14 and the cutter 31 from one side toward the other side of the lower blade 14, the direction of inclination of the cutter 31 with respect to the lower blade 14 is such that the side of the cutter 31 on the other side of the lower blade 14 is located closer to the lower blade 14. On the other hand, when the belt-shaped member B is cut by means of the lower blade 14 and the cutter 31 from the other side toward the one side, the direction of inclination of the cutter 31 is such that the side of the cutter 31 on the one side of the lower blade 14 is located closer to the lower blade 14. This revolving mechanism 54 is operated as it receives a driving force from a moving mechanism 55, which will be described later. In addition, the aforementioned pulleys 38, belt 39, and motor as a whole constitute the moving mechanism 55. As the moving mechanism 55 moves the cutter 31 and the holder 26 along the lower blade 14, the belt-shaped member B is cut in a substantially transverse direction at a cutting position through cooperation between the lower blade 14 and the cutter 31.

Figure 6:
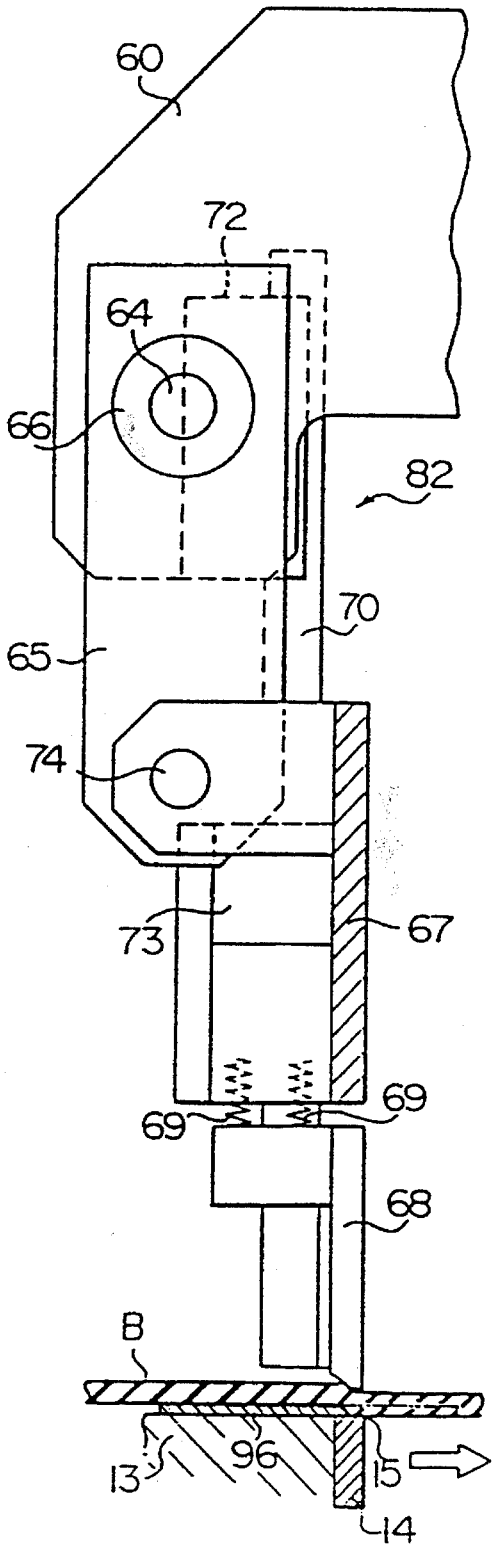
FIG. 6 is a cross-sectional view taken in the direction of arrows along line 6—6 in FIG. 1.

As shown in FIGS. 1, 2, and 6, brackets 60 are fixed on the front surface of the fixed beam 18 immediately above one end and the other end of the lower blade 14, respectively. Transmitting shafts 62, which are parallel with the lower blade 14, are respectively supported rotatably by the brackets 60 via a pair of bearings 61. Revolving members 63 are respectively secured to mutually opposing sides of the pair of transmitting shafts 62, and a supporting shaft 64 is fixed to each revolving member 63 at a position eccentric from the axis of rotation of the transmitting shaft 62. A cam follower 66 inserted in an upper end portion of a link 65 is rotatably supported by each supporting shaft 64. Lower ends of the links 65 are respectively rotatably connected via support shafts 74 to opposite ends of a lifting beam 67 extending in parallel with the longitudinal direction of the lower blade 14 above the lower blade 14. A pressing plate 68 extending along the longitudinal direction of the lower blade 14 is disposed immediately above the belt-shaped member B between lifting beam 67 and the lower blade 14. Opposite ends of this pressing plate 68 and opposite ends of the lifting beam 67 are connected to each other via a plurality of springs 69. Lower ends of a plurality of (in this embodiment, three) slide rails 70 extending in the vertical direction are secured to the pressing plate 68, and these slide rails 70 are arranged at predetermined intervals in the longitudinal direction of the lower blade 14. As shown in FIG. 2, a plurality of (in this embodiment, three) brackets 71 are mounted on the front surface of the fixed beam 18, and slide bearings 72, which upper ends of the slide rails 70 slidably engage, are respectively secured to the brackets 71. Three slide bearings 73 are fixed to the lifting beam 67, and central portions of the slide rails 70 slidably engage these slide bearings 73. As a result, when each transmitting shaft 62 rotates to cause the revolving member 63 to rotate with the transmitting shaft 62 as a center, since the support shaft 64 and the cam follower 66 are disposed eccentrically from the transmitting shaft 62, the link 65 is vertically moved, so that the lifting beam 67 and the pressing plate 68 are vertically moved while being guided by the slide rails 70 and the slide bearings 72 and 73. Then, when the lifting beam 67 is lowered, and the pressing plate 68 presses the belt-shaped member B against the upper surface of the lower blade 14 by means of the resiliency of the springs 69 immediately before the cutting position, the movement of the belt-shaped member B is restricted during cutting. As shown in FIG. 2, an AC servo motor 76 is mounted on the upper surface of the fixed beam 18, and the rotation of this motor 76 is transmitted to a transmitting shaft 79 which is rotatably supported by bearings 78 via a belt 77. The rotation of this transmitting shaft 79 is transmitted to pulleys 81 (see FIG. 1) mounted on the transmitting shafts 62 via belts 80. The aforementioned revolving member 63, support shaft 64, link 65, cam follower 66, lifting beam 67, and slide bearings 72 and 73 as a whole constitute a pressing mechanism 82. This pressing mechanism 82 moves the pressing plate 68, causes the belt-shaped member B in the vicinity of the cutting position to be pressed against the upper surface of the lower blade 14 so as to restrict the movement of the belt-shaped member B during cutting.

Figure 7:
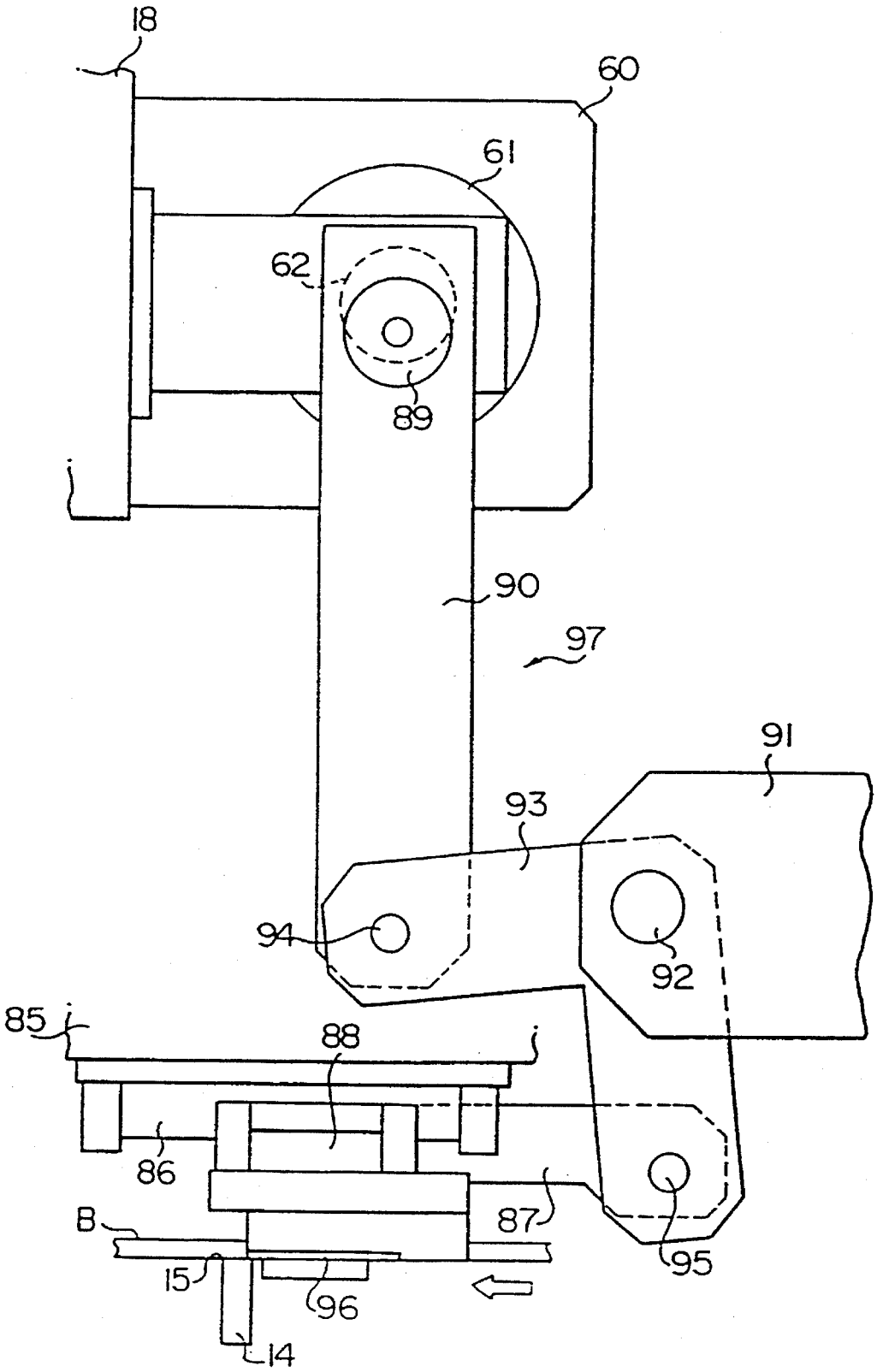
FIG. 7 is a view taken in the direction of arrows 7—7 in FIG. 2.

As shown in FIGS. 1, 2, and 7, a support beam 85 extending in the transverse direction of the apparatus is fixed to the front surface of each of the legs 17, and a slide bearing 88 fixed to a slider 87 is slidably engaged with a slide rail 86 extending in the transverse direction of the apparatus (in the left-and-right direction in FIG. 7). As shown in FIGS. 1 and 7, an eccentric cam 89 is mounted on each of the outer sides of the pair of transmitting shafts 62, and each eccentric cam 89 is disposed eccentrically with respect to the axis of rotation of the transmitting shaft 62 by a predetermined distance. The eccentric cam 89 is inserted in an upper end of a link 90 extending vertically, and the link 90 is connected to the transmitting shaft 62. A lower end of each link 90 is connected via a pin 94 to an end of an L-shaped link 93 which is in turn connected via a pin 92 to a bracket 91 attached to the leg 17. Each of the sliders 87 is connected to the other end of each L-shaped link 93 via a pin 95. In addition, connected to these sliders 87 are opposite ends of a thin plate-shaped releasing member 96, which is disposed immediately below the belt-shaped member B in the vicinity of the cutting position and extends along the longitudinal direction of the lower blade 14 in parallel with the upper surface of the lower blade 14. When the belt-shaped member B is cut by the lower blade 14 and the cutter 31 at the cutting position, and the pressing plate 68 moves upward immediately thereafter and is disengaged from the belt-shaped member B, this releasing member 96 is adapted to move in a direction substantially perpendicular to the longitudinal direction of the lower blade 14 (in the rearward direction) and is inserted between the belt-shaped member B and the lower blade 14. This movement of the releasing member 96 is effected as follows: As the eccentric cam 89 revolves about the axis of rotation of the transmitting shaft 62 through the rotation of the transmitting shaft 62, the link 90 moves vertically, which in turn causes the L-shaped link 93 to swing about the pin 92. The aforementioned slider 87, eccentric cam 89, link 90, and L-shaped link 93 as a whole constitute a pushing mechanism 97. As this pushing mechanism 97 pushes the releasing member 96 between the belt-shaped member B and the lower blade 14, the belt-shaped member B adhering to the lower blade 14 is released from the lower blade 14. The aforementioned transmitting shaft 62, motor 76, belt 77, transmitting shaft 79, belt 80, and pulley 81 as a whole constitute a driving mechanism 98 for imparting a driving force to both the pressing mechanism 82 and the pushing mechanism 97. If the driving force is thus imparted to both the pressing mechanism 82 and the pushing mechanism 97 by one driving mechanism 98, the driving mechanism 98 becomes compact and can be produced at low cost. Moreover, since the pushing mechanism 97 and the driving mechanism 98 are constituted by a motor and a link mechanism, there is no lag in timing such as the one occurring when these mechanisms are constituted by air cylinders, so that the efficiency of the cutting operation improves.

Next, a description will be given of the operation of this embodiment.

It is now assumed that the position for cutting the belt-shaped member B is located above the lower blade 14, that the lifting beam 67 and the pressing plate 68 are on standby above the position for cutting the belt-shaped member B, and that the carriage 21 and the cutter 31 are also on standby at one end of the lower blade 14. At this time, the cutter 31 is inclined with respect to the lower blade 14 while maintaining the very small angle b such that the side of the cutter 31 on the other side of the lower blade 14 is located closer to the lower blade 14.

Next, the motor 76 is operated to rotate the transmitting shafts 79 and 62. As the transmitting shafts 62 rotate, each eccentric cam 89 eccentrically rotates about the axis of rotation of the respective transmitting shaft 62, so that the link 90 is pushed downward by the eccentric cam 89. As a result, each L-shaped link 93 swings about the pin 92, which in turn causes the slider 87 to move in the forward direction while being guided by the slide rail 86. Consequently, the releasing member 96 retracts until its rear end is located forwardly of the cutting edge 15 of the lower blade 14 and is retreated from the path of movement of the cutter 31. Meanwhile, as each transmitting shaft 62 rotates, the cam follower 66 eccentrically revolves about the axis of rotation of the transmitting shaft 62. This eccentric revolution pushes down the link 65, with the result that the lifting beam 67 is lowered while being guided by the slide rails 70 and the slide bearings 72, so that the pressing plate 68 moves toward the lower blade 14. Since each link 65 is pressed downward even after the pressing plate 68 is brought into contact with the upper surface of the belt-shaped member B, the springs 69 are compressed and their resiliency is imparted to the pressing plate 68. Hence, the pressing plate 68 presses a portion of the belt-shaped member B located immediately before the cutting position against the upper surface of the lower blade 14 with a fixed force. In this state, the motor 76 is temporarily stopped.

Next, the pulleys 38 shown in FIG. 3 are driven and rotated by an unillustrated motor, causing the belt 39 to travel. As a result, the carriage 21 and the cutter 31 move from one side toward the other along the lower blade 14 while being guided by the guide rails 19. At this time, the cutter 31 is inclined with respect to the lower blade 14 at the very small angle b, as described above, a portion of its outer edge abuts against the cutting edge 15 of the lower blade 14 with a fixed force by receiving the urging force of the spring 36, and the cutter 31 is supported by the bearings 28 in the carriage 21 in such a manner as to be capable of rotating freely about the axis of rotation, K. Therefore, the belt-shaped member B is cut substantially in the transverse direction by means of the cutter 31 and the cutting edge 15 of the lower blade 14. At this time, since the pressing plate 68 presses the belt-shaped member B in the vicinity of the cutting position against the lower blade 14, the movement of the belt-shaped member B is restricted. This process in which the belt-shaped member B is cut by moving the cutter 31 from one side toward the other is an advance cutting process.

When the cutting of the belt-shaped member B is thus completed, the traveling speed of the belt 39 is decelerated, and the other end of the rack shaft 41 supported in the carriage 21 is subsequently brought into contact with an end face of the stopper 53. After this contact, the carriage 21 continues to move at a low speed toward the other end, so that the rack shaft 41 is pushed further in the carriage toward one side. At this time, since the pinion teeth 43 of the holder 26 are meshed with the rack 42 of the rack shaft 41, the movement of the rack shaft 41 causes the holder 26 to revolve about the axis of revolution, S. When the holder 26 revolves 180 degrees, the belt 36 stops traveling. At this time, since the axis of rotation, K, and the axis of revolution, S, intersect each other by maintaining the very small angle a, the revolution of the holder 26 causes the cutter 31 to undergo precession about the axis of revolution S. Consequently, the direction of inclination of the cutter 31 with respect to the lower blade 14 is inverted such that the side of the cutter 31 on one side of the lower blade 14 becomes located closer to the lower blade 14. The revolution of this holder 26 stops when the angle of inclination of the cutter 31 with respect to the lower blade 14 becomes the predetermined very small angle b. At this time, the permanent magnet 45 fixed to the rack shaft 41 abuts against the iron piece 47, and the iron piece 47 remains attracted to the permanent magnet 45. The aforementioned angle of inclination of the holder 26 is reliably maintained as the iron piece 47 is attracted by the permanent magnet 45, thereby restricting the movement of the rack shaft 41. This process in which the direction of inclination of the cutter 31 with respect to the lower blade 14 is inverted is an inverting process.

Next, the motor 76 is operated again to rotate the transmitting shafts 79 and 62. As a result, each cam follower eccentrically revolves about the axis of rotation of the transmitting shaft 62, which in turn causes the links 65, the lifting beam 67, and the pressing plate 68 to move upward, allowing the pressing plate 68 to be disengaged from the belt-shaped member B in the upward direction. Here, since the portion of the belt-shaped member B located in the vicinity of the cutting position is pressed firmly against the lower blade 14 by means of the cutter 31 and the pressing plate 68 as described above, that portion of the belt-shaped member B adheres to the lower blade 14. For this reason, each eccentric cam 89 is made to revolve eccentrically about the axis of rotation of the transmitting shaft 62 by means of the transmitting shaft 62, thereby lifting the link 90 by means of the eccentric cam 89. As a result, each L-shaped link 93 is swung about the pin 92, thereby causing the slider 87 to move in the rearward direction (indicated by the arrow in FIG. 7) along the slide rail 86. Through such movement of the sliders 87, the releasing member 96 is pushed in between the lower blade 14 and the belt-shaped member B in the vicinity of the cutting position, as shown by the phantom line in FIG. 6, thereby releasing the belt-shaped member B adhering to the lower blade 14 from the lower blade 14.

At this time, since the releasing member 96 has the configuration of a thin plate, and is moved along the upper surface of the lower blade 14 in a direction substantially perpendicular to the longitudinal direction of the lower blade 14 (i.e., in the rearward direction), the deformation of the belt-shaped member B during releasing is practically nil as compared with the case where the belt-shaped member B is pushed upward so as to be released from the lower blade 14. Thus, the quality of the cut belt-shaped member B improves. Then, the belt-shaped member B is fed by a predetermined length in the rearward direction (in the direction of the arrow in FIG. 5) by an unillustrated conveyor, so that an ensuing cutting position of the belt-shaped member B reaches the position above the cutting edge 15 of the lower blade 14.

Next, the motor 76 is operated to cause the releasing member 96 to be retreated in the forward direction so as not to hamper the operation of the cutter 31. At the same time, the lifting beam 67 is lowered, and the portion of the belt-shaped member B located immediately before the cutting position is pressed against the lower blade 14 by means of the pressing plate 68. In this state, the belt 39 is made to travel again, so that the cutter 31 moves along the lower blade 14 from the other side toward one side while being brought into contact with the lower blade 14, thereby cutting the belt-shaped member B at the cutting position in the substantially transverse direction. This process in which the belt-shaped member B is cut by moving the cutter 31 from the other side toward one side is a return cutting process.

When the cutting of the belt-shaped member B is completed, the belt 39 travels at a decelerated speed, the rack shaft 41 is pushed in at low speed until it is brought into contact with the stopper 52 and the permanent magnet 44 and the iron piece 46 abut against each other with the iron piece 46 attracted by the permanent magnet 44. As a result, the holder 26 revolves 180 degrees, and the direction of inclination of the cutter 31 with respect to the lower blade 14 and the angle of inclination thereof return to those persisting in the above-described advance cutting process. Next, the belt-shaped member B is fed by a predetermined length in the rearward direction. This process is a resetting process.

Thus, since the direction of inclination of the cutter 31 with respect to the lower blade 14 is inverted each time the cutting of the belt-shaped member B is completed, it is possible to cut the belt-shaped member B not only during the movement of the cutter 31 from one side toward the other but also during the movement of the cutter 31 from the other side toward one side. As a result, the operations of returning the cutter 31 from the other side to one side and lifting the cutter 31 become unnecessary, so that the efficiency of the cutting operation improves. In addition, since hoses and wiring become unnecessary. the breakage of the otherwise required hoses, wiring and the like do not occur, and reliability improves. Furthermore, since the inversion of the direction of inclination of the cutter 31 with respect to the lower blade 14 is effected by revolving the holder 26 about the axis of revolution, S, the accuracy of inclination with respect to the lower blade 14 after inversion becomes high as compared with a case where the cutter 31 is directly made to undergo precession about the axis of rotation, K, by means of a cylinder, a cam, or the like. Consequently, the cutting of the belt-shaped member B can be effected accurately and reliably. The foregoing operation constitutes one cycle of the operation in accordance with this embodiment, and this cycle is repeated thereafter to cut the belt-shaped member B consecutively into predetermined lengths.

It should be noted that although, in the above-described embodiment, the holder 26 is revolved 180 degrees to invert and reset the direction of inclination of the cutter 31 with respect to the lower blade 14 and the angle of inclination thereof, in the present invention the holder 26 may be revolved through another angle, e.g., 90 degrees or 120 degrees to effect inversion and resetting.

As described above, in accordance with the present invention, not only can the belt-shaped member be cut with high efficiency, but the belt-shaped member adhering to the lower blade can be released from the lower blade after cutting with substantially no deformation of the belt-shaped member.

What is claimed is:

1. A method for cutting a belt-shaped member, comprising the steps of:

cutting the belt-shaped member substantially transversely by moving a cutter along a lower blade from a first end of said lower blade to a second end of said lower blade while said cutter is held in contact with said lower blade in a state in which said cutter is inclined at a first small angle with respect to said lower blade such that a side of said cutter closest to the second end of said lower blade is located closer to said lower blade than a side of said cutter farthest from the second end of said lower blade, so as to effect an advance cutting step;

causing said cutter to undergo precession about an axis of revolution which intersects an axis of rotation of said cutter by maintaining a second small angle to the axis of rotation of said cutter so that the cutter is inclined first with respect to said lower blade such that a side of said cutter closest to the first end of said lower blade is located closer to said lower blade than a side of said cutter farthest from the first end of said lower blade, and feeding the belt shaped member by a predetermined length, so as to effect an inverting step;

cutting the belt-shaped member substantially transversely by moving said cutter along said lower blade from the second end to the first end of said lower blade while said cutter is being held in contact with said lower blade, so as to effect a return cutting step; and causing said cutter to undergo precession about the axis of revolution to reset a direction and an angle of inclination of said cutter with respect to said lower blade to those persisting in the advance cutting step, and feeding the belt-shaped member by the predetermined length, so as to effect a resetting step.

2. The method for cutting a belt-shaped member according to claim 1, further comprising a step of providing a holder with a shaft on which said disk-shaped cutter is rotatably supported, wherein said cutter rotates freely on the shaft of said holder in the advance cutting step and the return step to cut the belt-shaped member.

3. The method for cutting a belt-shaped member according to claim 1, further comprising a step of providing a holder having a shaft on which said cutter is rotatably supported, and rotating said holder by 180° in the inverting and resetting steps to cause said cutter to undergo said precession.

4. An apparatus for cutting a belt-shaped member, comprising:

a lower blade disposed immediately below the belt-shaped member and extending perpendicular to a longitudinal direction of the belt-shaped member;

a disk-shaped cutter adjacent the lower blade for cutting the belt-shaped member in cooperation with said lower blade as a portion of said cutter is brought into contact with said lower blade, and wherein said cutter is inclined while maintaining a first small angle with respect to said lower blade;

a holder rotatably supporting said cutter;

carriage means for supporting said holder so that said holder is free to rotate about an axis of revolution intersecting an axis of rotation of said cutter and maintains a second small angle to the axis of rotation of said cutter;

rotating means for rotating said holder about the axis of revolution with respect to said carriage to cause said cutter to undergo precession about the axis of revolution, a direction of inclination of said cutter being set such that, when the belt-shaped member is cut from a first end of said lower blade toward a second end of said lower blade, a side of said cutter closest to the second end of said lower blade is located closer to said lower blade than a side of said cutter farthest from the second end of said lower blade, while when the belt-shaped member is cut from the second end toward the first end of said lower blade, a side of said cutter closest to the first end of said lower blade is located closer to said lower blade than a side of said cutter farthest from the first end of said lower blade; and moving means for moving said carriage to move said cutter and said holder along said lower blade so as to cut the belt-shaped member by means of said lower blade and said cutter.

5. The apparatus for cutting a belt-shaped member according to claim 4, wherein said holder is formed in a hollow cylindrical shape whose inner peripheral surface is inclined at the second small angle with respect to an outer peripheral surface thereof, and wherein said holder rotates about the axis of revolution which intersects the axis of rotation of said cutter and maintains the second small angle to the axis of rotation of said cutter.

6. The apparatus for cutting a belt-shaped member according to claim 5, wherein said holder has at least one bearing and a hollow shaft supported by said bearing, and said cutter is supported by said hollow shaft, wherein a shaft portion of said cutter is fitted in said hollow shaft.

7. The apparatus for cutting a belt-shaped member according to claim 5, further comprising means for biasing said cutter against said lower blade.

8. The apparatus for cutting a belt-shaped member according to claim 5, wherein said moving means comprises a guide rail disposed along said lower blade for guiding said carriage.

9. The apparatus for cutting a belt-shaped member according to claim 5, wherein said moving means comprises a belt whose opposite ends are connected to said carriage and a pair of pulleys between which said belt is trained, and wherein said cutter and said holder are moved along said lower blade as said belt travels.

10. The apparatus for cutting a belt-shaped member according to claim 4, wherein said holder has at least one bearing and a hollow shaft supported by said bearing, and said cutter is supported by said hollow shaft, wherein a shaft portion of said cutter is fitted in said hollow shaft.

11. The apparatus for cutting a belt-shaped member according to claim 4, further comprising means for biasing said cutter against said lower blade.

12. The apparatus for cutting a belt-shaped member according to claim 4, wherein said holder has pinion teeth on its outer periphery, and wherein a rack shaft is slidably supported by said carriage means and comprises a rack which engages said pinion teeth, whereby movement of said rack shaft relative to said carriage causes said cutter to undergo said precession about the axis of revolution as said rack is meshed with said pinion teeth.

13. The apparatus for cutting a belt-shaped member according to claim 4, wherein said moving means comprises at least one guide rail disposed along said lower blade for guiding said carriage.

14. The apparatus for cutting a belt-shaped member according to claim 4, wherein said moving means comprises a belt whose opposite ends are connected to said carriage and a pair of pulleys between which said belt is trained, and wherein said cutter and said holder are moved along said lower blade as said belt travels.

* * * * *